US005598782A

United States Patent [19]

Wiseman et al.

[11] Patent Number: 5,598,782

[45] Date of Patent: Feb. 4, 1997

[54] METHODS OF RAILWAY TRACK MAINTENANCE

[75] Inventors: Paul W. Wiseman, Didcot; David C. Marriott, Beeston, both of England

[73] Assignee: British Railways Board, London, England

[21] Appl. No.: 338,454

[22] PCT Filed: Jun. 2, 1993

[86] PCT No.: PCT/GB93/01174

§ 371 Date: Nov. 15, 1994

§ 102(e) Date: Nov. 15, 1994

[87] PCT Pub. No.: WO93/25760

PCT Pub. Date: Dec. 23, 1993

[30] Foreign Application Priority Data

Jun. 5, 1992 [GB] United Kingdom ..... 9211901

[51] Int. Cl.[6] ..... E01B 33/00

[52] U.S. Cl. ..... 104/7.2; 104/2

[58] Field of Search ..... 104/8, 7.2, 7.3, 104/2; 33/1 Q, 287

[56] References Cited

U.S. PATENT DOCUMENTS

| | | | |
|---|---|---|---|
| 3,486,461 | 12/1969 | Plasser et al. | 104/8 |
| 3,552,319 | 1/1971 | Flasser | 104/8 |
| 4,031,625 | 6/1977 | Theurer . | |
| 4,176,456 | 12/1979 | Beckmann | 33/287 |
| 4,497,255 | 2/1985 | Theurer | 33/1 Q |
| 5,012,413 | 4/1991 | Sroka et al. | 33/1 Q |

FOREIGN PATENT DOCUMENTS

| | | | |
|---|---|---|---|
| 2300171 | 9/1976 | France . | |
| 1784148 | 7/1971 | Germany | 104/8 |
| 2036379 | 6/1980 | United Kingdom . | |
| 2112050 | 7/1983 | United Kingdom . | |

*Primary Examiner*—Mark T. Le
*Attorney, Agent, or Firm*—Davis and Bujold

[57] ABSTRACT

A method of adjusting the geometry of a stretch of a railway track uses a track maintenance machine which runs on the track and which has at least one measuring reference system (13) guided by feelers (10,12) on the track and sensors (14,15) for determining the position of the track relative to the measuring reference system (13) and which also has track correcting tools (16). The method comprises performing a preliminary measuring run to acquire a series of track measurements at spaced points along the track by the sensor (14). A design profile is then determined from these measurements and correction values prescribed necessary to achieve the design profile. Then a maintenance run is performed during which the track correcting tools are controlled in accordance with the prescribed correction values whereby to adjust the track geometry. Also during both the preliminary measuring run and the maintenance run a second series of track measurement is made by sensor (15) at spaced points along the track and offsets measured by the sensor (15) during the preliminary measuring run and the maintenance run are used to determine the actual adjustment values made at the spaced points along the track.

15 Claims, 2 Drawing Sheets

METHODS OF RAILWAY TRACK MAINTENANCE

Figure 1:
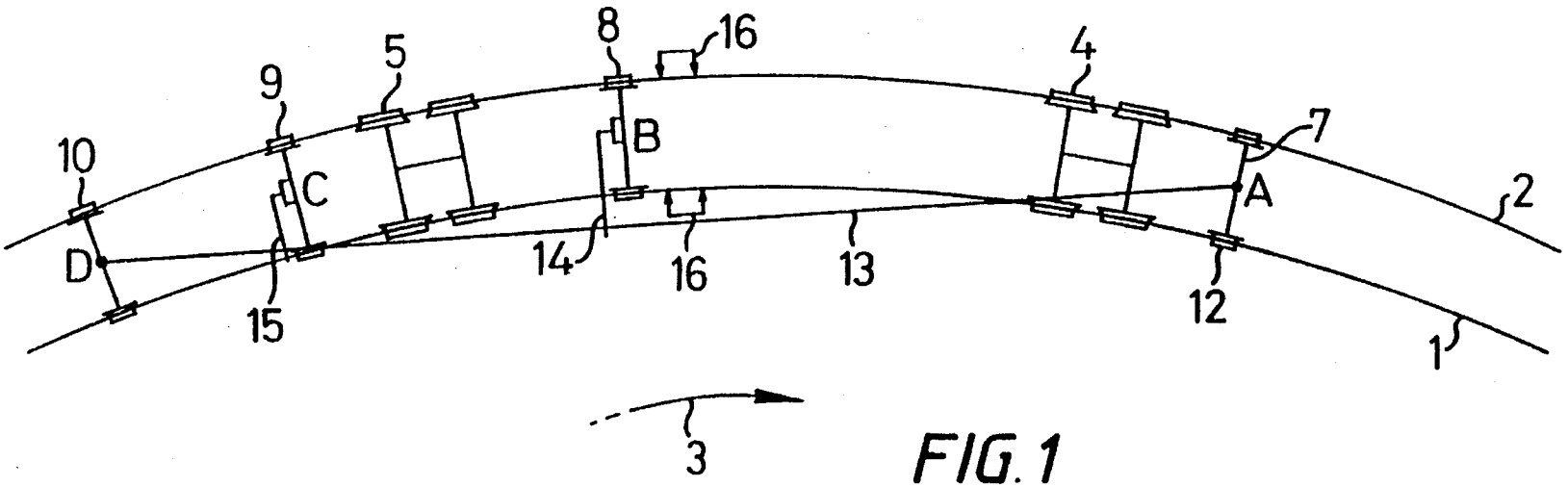

This invention relates to methods of railway track maintenance utilizing a track maintenance machine which runs on the track. The invention is applicable to both the correction of horizontal track geometry (i.e. alignment) and vertical track geometry (i.e. level). Track lining systems are described for example in GB-A-21112050 and FR-A-2300171.

The present invention is based upon the known two-pass track maintenance method in which a survey of a stretch of track to be maintained is first made and from the data obtained an improved horizontal or vertical track geometry (i.e a design profile) is determined and the necessary adjustments to be made to the track to achieve the design profile calculated. The predetermined adjustments are then made by the track maintenance machine as it runs along the track.

One such commonly used method for track alignment involves the use of a lining machine fitted with a measuring system for measuring the local curvature of the track. The survey comprises a preliminary measuring run by the machine during which the pattern of curvature is recorded throughout the stretch of track to be maintained An improved pattern of track curvature, i.e. the design profile, is determined either by graphical or computational means. This then provides the basis for determining the correction values necessary to achieve she design profile. These correction values are then used to control the sluing of the track as the machine passes along the stretch of track during a subsequent maintenance run. Such a method is described in GB 2036379B.

The accuracy of track lining by this method is significantly compromised however by errors in the sluing of the track. These errors arise from a number of sources, such as the natural lateral stiffness of the track structure which causes track "springback" immediately after lining, and tolerances n the lining control system. On most machines the track is tamped after lining has taken place and this often causes the track to slide sideways, especially where heavily canted.

In the case of track level adjustment by tamping a similar method to that described above may be applied to the correction of vertical track misalignments. Again the survey comprises a preliminary measuring run by a track level correcting machine during which track level measurements are recorded throughout the stretch of track to be maintained in order to determine the existing track profile from which an improved vertical track profile, i.e. the design profile,can be determined. This then provides the basis for determining the correction values necessary to achieve the design profile. These correction values are then used to control the lifting of the track as the machine passes along the stretch of track during a subsequent maintenance run. The accuracy of track lifting can be somewhat unpredictable for various reasons and errors can be introduced into the vertical track geometry.

It is the object of this invention to provide an improved method of railway track maintenance by countering the aforesaid problems in achieving the design profile.

According to the present invention a method of adjusting the geometry of a stretch of railway track using a track maintenance machine which runs on the track and which has a) track correcting tools, b) at least one measuring reference system guided by feelers on the track and comprising at least one straight reference line extending from a front position located forwardly of the track maintenance machine on uncorrected track to a rear position located rearwardly of the machine on corrected track and c) a sensor arrangement comprising a first sensor means located in the vicinity of the track correcting tools and a second sensor means located rearwardly of the rearmost load bearing wheels of the track maintenance machine for measuring the respective offsets of the track from said line at these locations, the method comprising performing a preliminary measuring run to acquire a series of track measurements at spaced points along the track by said first sensor means, determining a design profile from these measurements and prescribing the correction values necessary to achieve the design profile and then performing a maintenance run during which the track correcting tools are controlled in accordance with said prescribed correction values whereby to adjust the track geometry, is characterised in that during both the preliminary measuring run and the maintenance run a second series of track measurements is made by said second sensor means at spaced points along the track and offsets measured by said second sensor means during the preliminary measuring run and the maintenance run are used to determine the actual adjustment values made at said spaced points along the track.

Said determined adjustment values may be used during the maintenance run as the adjustment values made at the rear position of the reference line as said rear position reaches each of said spaced points in turn in order to define accurately the rear position of said reference line.

Said reference line may comprise a wire extending from a front feeler to a rear feeler. However other types of measuring reference system could be used. For example the reference line could be a beam of electromagnetic radiation such as a laser beam.

Figure 2:
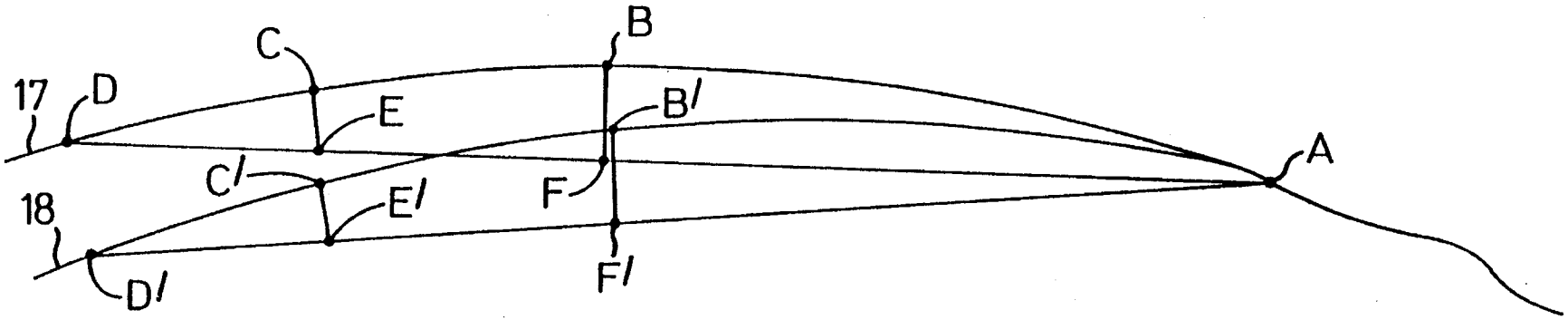
Figure 3:
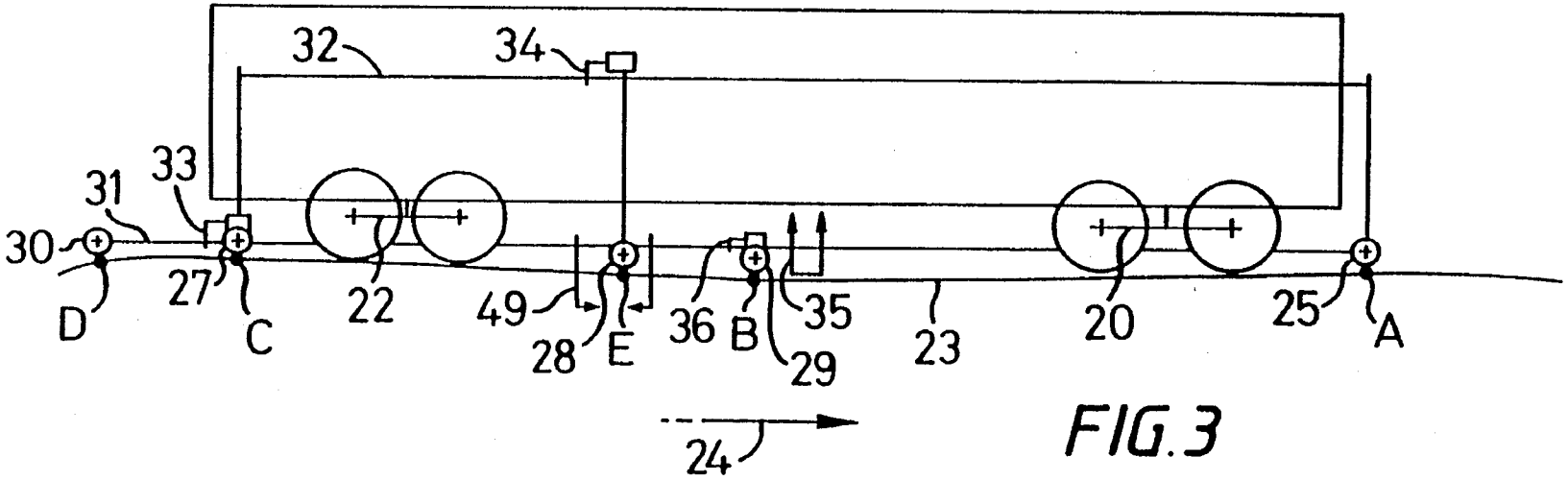

Exemplary embodiments of the invention will now be described with reference to the accompanying diagrammatic drawings, in which:

FIGS. 1 and 2 serve to explain a track alignment method,

FIG. 3 serves to explain a first track level correction method, and

Figure 4:
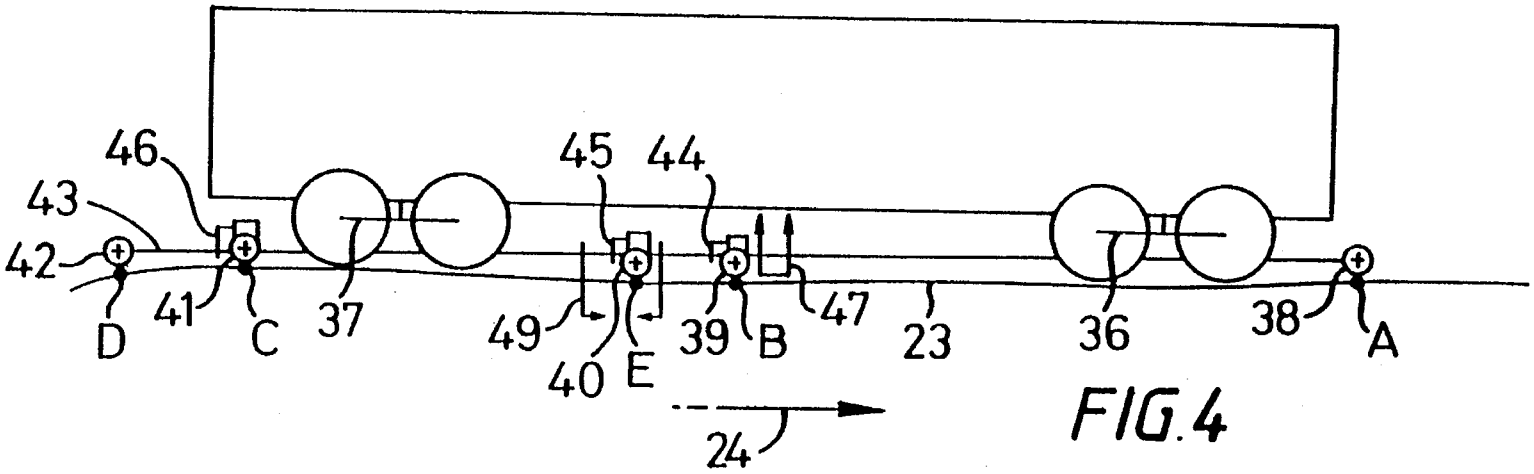

FIG. 4 serves to explain a second track level correction method.

Referring now to FIG. 1, a curved section of railway track is shown having running rails 1 and 2, on which a track lining machine is located, which during a maintenance run travels in the direction of arrow 3. The lining machine is represented by foremost and rearmost load bearing bogies 4 and 5 respectively. The curvature of the track is shown exaggerated for convenience of explanation. The machine has four feelers 7, 8, 9 and 10 guided on the track. These feelers are in the form of trollies having flanged wheels 12 running on the track. A measuring reference system in the form of a wire 13 extends as a chord to the track from point A on the front feeler 7 located on uncorrected track to point D on the rear feeler 10 located on corrected track. Sensor means comprising sensors 14 and 15 are carried by the feelers 8 and 9 respectively and measure the horizontal offsets of the wire chord 13 from the points B and C respectively, i.e. the distance of the wire chord 13 from the points B and C. The points A to D may conveniently, but not essentially, lie on the centre-line of the track or a line parallel thereto so that the sensors 14 and 15 effectively measure the offsets of the chord from the centre-line of the track. Each of the feelers 7 to 10 is preloaded laterally towards one of the rails 1 and 2, i.e. the "reference rail", so that the points A to D each reside at the same constant distance from this rail. Track correcting tools for realigning or sluing the track are represented at 16 and are located just ahead of the feeler 8.

In carrying out a lining operation an on-board computer is used to acquire a first series of measurements from the sensor 14 at a regular distance spacing as the machine traverses the stretch of track during a preliminary measuring run. These measurements are then used as a basis for calculating a preferred alignment (i.e. a design profile). The desired offsets of the wire chord 13 from the point B to achieve the preferred alignment are also calculated. These offset values are determined making allowance for the anticipated movement of the rear of the chord, i.e. at point D, since this will have been slued from its original position when measuring the chord offsets as the machine proceeds along the track during the subsequent maintenance run. During the maintenance run the computer control system automatically feeds correction signals to the slue controller for the tools 16 as the machine travels along the stretch of track.

The accuracy of this method of track lining is, as previously stated, compromised by errors in the sluing of the track arising from a number of sources. These sources of error are further amplified because they cause the rear of the chord at point D not to be at its anticipated position after sluing. The errors thus arising in the measuring reference system will be fed back into the control of slue at the current lining position unless measures are taken to counter these errors. The provision of the feeler 9 and its associated sensor 15 enable these errors to be countered as will now be described.

The feeler 9 is located rearwardly of the rearmost load bearing bogie 5 at a position at which the track will not be subject to further movement as a result of sluing or tamping activity. The offsets of the chord from the point C are measured by the sensor 15 at regular distance spacing during the preliminary measuring run. The offsets from C are subsequently re-measured at the same distance locations during the maintenance run. Thus a second series of measurements are provided and from these the actual slues at C are calculated as the machine moves along the track. Hence as point D reaches one of the previous points C the actual value of slue measured for this point can be used in calculating the slue to be applied at B. Thus errors which could arise from the rear point of the wire chord not being at its anticipated position are avoided.

Referring to FIG. 2 the line 17 represents the track centre-line before the lining operation and the line 18 represents the track centre-line after lining up to the point B. The points A to D and the points A, B' to D' therefore correspond to the points A to D in FIG. 1 before and after lining. The slue at C is calculated from:

$$CC''(\text{slue at } C)=CE-C'E'+((CA/DA)*DD')$$

where C'E' is the post maintenance chord offset at C

CE is the pre-maintenance chord offset at C

DD' is the slue previously determined for point D

CA/DA is a constant

This equation will only be absolutely correct if C,C',E and E' all lie on a straight line, which will not quite be the case, but which is sufficiently accurate for practical values of curvature.

Since at the start of maintenance the slue DD' is zero, the first measurement of slue at C is simply CE–C'E'. As the machine progresses along the track, measurements of the slue at C are then made at regular distance spacings, e.g. 1 meter. For these measurements it is arranged that the value of DD' is then one of the previously measured values of slue at C. Hence the aforementioned regular distance spacing is equal to a sub-harmonic of the distance CD.

In addition to providing a method of improving slue accuracy as described below, this procedure is an efficient means of monitoring the actual slues which have been applied and the post maintenance position of the track, without recourse to a separate post maintenance measurement.

The sluing of the track at S is controlled by monitoring the offset B'F' of the chord at this point by the sensor 14. If the sensor 15 and the associated feeler 9 were not provided then the desired offset to achieve the design slue would be calculated, using an equation similar to that given above, namely:

$$BB'=BF-B'F'+((BA/DA)*DD')$$

and using the design slue at the rear point D of the chord. If there is an error value between the design slue and the actual slue achieved at D however this will be fed back into the calculation so that as the machine proceeds along the track the error in the calculated offset would be compounded.

By having the sensor 15 and the feeler 9 for monitoring the actual slues EE' applied at C the compounding of error may be avoided. This is achieved in that the value of slue at D is one of the previously actual measured values of slue at C. Thus the desired offset B'F' is calculated using the actual measured value of slue DD' at the rear point D of the chord derived from the actual slue EE' as described above, rather than the design value.

The sources of sluing error will be partly systematic and partly random. The degree of track springback experienced is generally dependent upon track condition and will therefore be roughly constant within a worksite or part of a site for a given size of slue. Tolerances in the slue control system will give rise to both predictable and random errors. Sliding of the track down the cant during tamping is largely systematic.

By monitoring the slue errors and determining the magnitude of the systematic errors within a worksite or part of a site, it is possible to calculate the expected error at the current lining position. Corrections may therefore be applied to the design slues in anticipation of these errors.

One method of applying corrections is to assume that the errors will be of the form:

$$\text{slue error}=L+M*\text{slue}+N*\text{cant}$$

Where L, M and N are constants.

Errors are then monitored over a short length of the work site, (e.g. ten successive maintenance locations) for which the applied slue and cant are known. The current best fit values of L, M and N are then determined by calculation. These constants are used to calculate the correction to be applied in controlling slue at the next maintenance position. Other simpler equations relating slue error to applied slue may also be used to determine the required corrections.

A rolling window of measured errors may be used to update the values of these constants as the machine passes through the work site. This method has the advantage of allowing for variations in the systematic causes of error, whilst discounting random sources of error.

A similar method to that described above may be applied to vertical track misalignments. Referring to FIG. 3, a track maintenance machine has bogies 20 and 22 running on the track 23 and during a maintenance run travels in the direction of arrow 24. The machine has feelers 25, 27, 28, 29 and 30 guided on the track. The feelers 25 and 30 support the ends of a first wire 31 constituting a first measuring reference system, on the track at points A and D. The feelers 25 and 27 support the ends of a second wire 32 constituting a second measuring reference system, on the track at points A and C. A sensor arrangement comprises a first sensor means having a sensor 36 carried by feeler 29 for determining the vertical offset of the track from the wire 31 at point B and a sensor 34 carried by feeler 28 for measuring the vertical offset of the track at point E from the wire 32. Second sensor means comprise a sensor 33 carried by feeler 27 for determining the vertical offset of the track from the wire 31 at point C A track lifting device is represented by arrows 35. As can be seen from FIG. 3, the feelers 27 and 30 are, during a maintenance run, located on the corrected track behind the rearmost load bearing wheelset of the machine, the feeler 25 is located on the uncorrected track ahead of the machine and the feeler 28 is located adjacent tamping tools 49 and the feeler 29 is located just behind the track lifting tools 35.

In carrying out the method vertical offsets of the track at B from the wire 31 are measured by sensor 36 at a regular distance spacing as the machine traverses the stretch of track during a preliminary measuring run. These are then used to determine the existing vertical track geometry from which an improved track profile (the design profile) can be computed. The desired offsets of the track from the wire 32 at point E to achieve the design profile during the maintenance run are also calculated from these measurements. During the maintenance run the sensor 34 monitors the offsets at E In the calculation it is assumed the level of the track at the feeler 27 during the maintenance run will be at the design value, Since however the track will settle after lifting and tamping as the rear wheelsets of the machine pass over it, the track at feeler 27 may not be at the design value and this will cause errors in the lift control system unless counter measures are taken.

By also monitoring the offset of the track at C from wire 31 during the maintenance run using sensor 33, the errors in the level of the track at the feeler 27 from the design value can be determined using an equation similar to that given above for alignment. These errors can then be compensated for in the monitoring of the track level by sensor 34 in order to give the design lift at point E.

This method also allows the initial settlement under the rear axle of the machine to be monitored. This information may be used to control overlifting of the track in anticipation of this settlement.

The above described track level correction method is designed to adjust one rail, (e.g the low rail), of the track to the design value. During the maintenance run the level of the high rail is raised by reference to the low rail to produce a design cant. The cant is determined by cross-level measurements using inclinometers in known manner.

An alternative embodiment of this invention also for application to the vertical control of tamping machines is illustrated in FIG. 4. The machine has bogies 36 and 37 running on the track and during a maintenance run travels in the direction of arrow 24. The machine has feelers 38,39, 40,41 and 42 guided on the track. Feelers 38 and 42 support the ends of a wire 43 constituting a measuring reference system, on the track at point A and D. A sensor arrangement comprises first sensor means having a sensor 44 carried by feeler 39 for measuring the vertical offset of the track from the wire at point B, essentially at the midpoint of AD and adjacent the lifting tools 47, and a sensor 45 carried by feeler 40 for measuring the vertical offset of the track from the wire 43 at point E adjacent to the tamping tools 49. Second sensor means comprise a sensor 46 for measuring the vertical offset of the track from the wire at point C. As can be seen from FIG. 4, the feelers 41 and 42 are, during a maintenance run, located behind the rearmost load bearing wheelset of the machine, and the feeler 38 is located on the uncorrected track ahead of the machine.

In carrying out the method, vertical offsets of the track at B from the wire 43 are measured by sensor 44 at a regular distance spacing as the machine traverses the stretch of track during a preliminary measuring run. These measurements are then used to determine the existing vertical track geometry from which an improved track profile (the design profile) can be computed. The desired offsets of the track from the wire 43 at point E, to achieve the design profile during the maintenance run are also calculated from those measurements. During the track maintenance run the sensor 45 monitors the level to which the track has been lifted. In the calculation it is assumed that the level of the track at the feeler 42 during the maintenance run will be at the design level. Since however the track will settle after tamping as the rear wheelsets of the machine pass over, the track at feeler 42 will not be at the design value, causing errors.

By also monitoring the offset of the track at C from the wire 43 during the maintenance run using sensor 46, the errors in level of the track at feeler 41 from the design value can be determined. As the machine moves forward the errors in the level of the track at feeler 42 from the design level may be determined and compensated for in the operation of the track lifting tools 47 to give the correct design lift at point E.

In a further embodiment the third sensor and the associated feeler shown at point E in FIGS. 3 and 4 are not used. The sensor at point B is used to monitor the level to which the track has been lifted at the track lifting tools during the maintenance run

We claim:

1. A method of adjusting a stretch of railway track using a track maintenance machine which runs on the track and which has a) track correcting tools, b) at least one measuring reference system guided by feelers on the track and comprising at least one straight reference line extending from a front position located forwardly of the track maintenance machine on uncorrected track to a rear position located rearwardly of rearmost load bearing wheels of the machine on corrected track and c) a sensor arrangement comprising a first sensor means located adjacent the track correcting tools and a second sensor means located rearwardly of the rearmost load bearing wheels of the track maintenance machine for measuring respective offsets of the track from said line comprising the steps of:

performing a preliminary measuring run to acquire a series of track measurements at spaced points along the track by said first sensor means;

determining a design profile from said measurements;

prescribing correction values necessary to achieve the design profile; and performing a maintenance run during which the track correcting tools are controlled in accordance with said prescribed correction values whereby to adjust a track geometry, wherein during both the preliminary measuring run and the maintenance run a second series of track measurements is made by said second sensor means at spaced points along the track and offsets measured by said second sensor means during the preliminary measuring run and the maintenance run are used to determine actual adjustment values made at said spaced points along the track.

2. A method according to claim 1, wherein said actual adjustment values are determined utilising the difference in the offsets measured at each of said spaced points by said second sensor means during the preliminary measuring run and the maintenance run.

3. A method according to claim 1 wherein said actual adjustment values are calculated according to the formula:

$$CC'=CE-C'E'+((CA/DA)*DD')$$

where

CC' is the actual adjustment value at point C,

CE is the offset measured at point C by the second sensor means during the preliminary measuring run C'E' is the offset measured at point C by the second sensor means during the maintenance run CA is the distance from the point C to the front position of the reference line DA is the distance between the front and rear positions of the reference line, and DD' is the actual adjustment value made previously at the rear position of the reference line.

4. A method according to claim 1 wherein said actual adjustment values are used during the maintenance run to determine a displacement of the rear position of the reference line from its position during the measuring run as said rear position reaches each of said spaced points in turn.

5. A method according to claim 1, wherein the measurements obtained from said first sensor means during the maintenance run are used to monitor the offsets of the track from said reference line in order to control the track correcting tools to apply the prescribed correction values.

6. A method according to claim 1 as applied to track alignment, wherein said first and second sensor means measure horizontal offsets of the track from said reference line.

7. A method according to claim 6, wherein systematic errors are compensated for in calculating the prescribed correction values to be applied.

8. A method according to claim 7, wherein the magnitude of the systematic errors are determined by monitoring slue errors within a worksite or part of a worksite.

9. A method according to claim 8, wherein the slue error is calculated according to the formula:

$$\text{slue error}=L+M*\text{slue}+N*\text{cant}$$

where L, M and N are constants and L, M and N are determined by measuring over a short length of a worksite for which the applied slue and cant are known and then these constants are used to calculate a prescribed slue value to be applied at a next maintenance position.

10. A method according to claim 9, wherein a rolling window of measured errors is used to update the constants as the machine passes through the worksite.

11. A method according to claim 1 applied to track level correction by tamping, wherein said first and second sensor means measure vertical offsets of the track from said reference line.

12. A method according to claim 11, wherein said first sensor means is used during the maintenance run to monitor the level at the position of the track correcting tools to which the track has been lifted.

13. A method according to claim 11, wherein said first sensor means comprises two sensors spaced from each other along the track, one of said two sensors being used during the preliminary measuring run and the other during the maintenance run.

14. A method according to claim 13, wherein said two sensors are associated with respective reference lines one of which extends from the position of said second sensor means to said front position.

15. A method according to claim 11, wherein said second series of measurements is utilised to control an overlifting of the track.

* * * * *